US007942387B2

(12) United States Patent
Forkosh

(10) Patent No.: US 7,942,387 B2
(45) Date of Patent: May 17, 2011

(54) SYSTEM AND METHOD FOR MANAGING WATER CONTENT IN A FLUID

(75) Inventor: Dan Forkosh, Atlit (IL)

(73) Assignee: DUCool Ltd., Kibbutz HaHotrim (IL)

( * ) Notice: Subject to any disclaimer, the term of this patent is extended or adjusted under 35 U.S.C. 154(b) by 316 days.

(21) Appl. No.: 12/438,617

(22) PCT Filed: Aug. 27, 2007

(86) PCT No.: PCT/IB2007/004333

§ 371 (c)(1),
(2), (4) Date: Feb. 24, 2009

(87) PCT Pub. No.: WO2008/053367

PCT Pub. Date: May 8, 2008

(65) Prior Publication Data

US 2010/0013112 A1 Jan. 21, 2010

Related U.S. Application Data

(60) Provisional application No. 60/840,312, filed on Aug. 25, 2006.

(51) Int. Cl.
*B01F 3/04* (2006.01)

(52) U.S. Cl. ..... 261/26; 62/94; 62/271; 95/231; 96/242; 96/249; 96/266; 261/36.1; 261/115; 261/118; 261/151

(58) Field of Classification Search ..... 261/21, 261/26, 36.1, 115–118, 151; 62/78, 94, 271, 62/310, 515; 95/187, 231; 96/242, 247, 96/249, 266
See application file for complete search history.

(56) References Cited

U.S. PATENT DOCUMENTS 2,672,024 A 3/1954 McGrath
2,798,570 A 7/1957 Kelley
(Continued)

FOREIGN PATENT DOCUMENTS

EP 1 510 768 A1 3/2005
(Continued)

OTHER PUBLICATIONS

Roland V. Wahlgren, Atmospheric Water Vapour Processor Designs For Potable Water Production: A Review; Wat. Res. vol. 35, No. 1, pp. 1-22, 2001.

*Primary Examiner* — Richard L Chiesa
(74) *Attorney, Agent, or Firm* — Brooks Kushman P.C.

(57) ABSTRACT

A system and method for managing water content in a fluid include a collection chamber for collecting water from the fluid with a desiccant, and a regeneration chamber for collecting water from the desiccant and transferring it to a second fluid. An evaporator cools the desiccant entering the collection chamber, and a condenser heats the desiccant entering the regeneration chamber. Diluted desiccant from the collection chamber is exchanged with concentrated desiccant from the regeneration chamber in such a way as to efficiently control the transfer of both mass and heat between the chambers. In one embodiment, mass is not exchanged until one or both of the desiccant levels in the chambers exceeds a predetermined level. Heat is transferred between the two desiccant flows as they are transferred between the chambers. This increases efficiency and reduces the energy input required for the evaporator and the condenser.

18 Claims, 2 Drawing Sheets

U.S. PATENT DOCUMENTS 2,935,154 A 5/1960 Kelley
3,018,231 A 1/1962 Valentine et al.
3,266,784 A 8/1966 Saito
4,134,743 A 1/1979 Macriss et al.
4,171,624 A 10/1979 Meckler et al.
4,180,985 A 1/1980 Northrup, Jr.
4,197,713 A 4/1980 Bulang
4,299,599 A 11/1981 Takeyama et al.
4,312,640 A 1/1982 Verrando
4,313,312 A 2/1982 Ito et al.
4,365,979 A 12/1982 Takeyama et al.
4,398,927 A 8/1983 Asher et al.
4,527,398 A 7/1985 Schaetzle
4,783,432 A 11/1988 Settlemyer
4,832,711 A 5/1989 Christel et al.
4,860,548 A * 8/1989 Ryham ..... 62/94
4,939,906 A 7/1990 Spatz et al.
4,941,324 A 7/1990 Peterson et al.
4,955,205 A 9/1990 Wilkinson
5,020,335 A 6/1991 Albers et al.
5,097,668 A 3/1992 Albers et al.
5,191,771 A * 3/1993 Meckler ..... 62/271
5,233,843 A 8/1993 Clarke
5,448,895 A 9/1995 Coellner et al.
5,669,221 A 9/1997 LeBleu et al.
5,699,673 A 12/1997 Hoshino et al.
5,817,167 A 10/1998 DesChamps
5,845,504 A 12/1998 LeBleu
5,857,344 A 1/1999 Rosenthal
5,953,926 A 9/1999 Dressler et al.
6,018,954 A * 2/2000 Assaf ..... 62/94
6,058,718 A 5/2000 Forsberg et al.
6,134,903 A 10/2000 Potnis et al.
6,182,453 B1 2/2001 Forsberg
6,199,389 B1 3/2001 Maeda
6,226,888 B1 5/2001 Lang
6,230,503 B1 5/2001 Spletzer
6,251,172 B1 6/2001 Conrad
6,336,957 B1 1/2002 Tsymerman
6,453,684 B1 9/2002 Spletzer et al.
6,463,750 B2 * 10/2002 Assaf ..... 62/271
6,481,222 B1 11/2002 Denniston
6,487,872 B1 12/2002 Forkosh et al.
6,494,053 B1 12/2002 Forkosh et al.
6,511,525 B2 1/2003 Spletzer et al.
6,514,321 B1 2/2003 Lehto et al.
6,546,746 B2 4/2003 Forkosh et al.
6,821,443 B2 11/2004 Kim
6,863,711 B2 3/2005 Tongue et al.
6,869,464 B2 3/2005 Klemic
6,976,365 B2 * 12/2005 Forkosh et al. ..... 62/94
7,043,934 B2 5/2006 Radermacher et al.
7,269,966 B2 9/2007 Lowenstein et al.
7,306,650 B2 12/2007 Slayzak et al.
7,430,878 B2 10/2008 Assaf
2001/0015072 A1 * 8/2001 Assaf ..... 62/271
2001/0015077 A1 8/2001 Potnis et al.
2003/0014983 A1 1/2003 Maisotsenko et al.
2003/0221438 A1 12/2003 Rane et al.
2004/0112077 A1 * 6/2004 Forkosh et al. ..... 62/271
2004/0168462 A1 * 9/2004 Assaf ..... 62/271
2004/0194478 A1 10/2004 Maeda et al.
2004/0231512 A1 11/2004 Slayzak et al.
2005/0109052 A1 * 5/2005 Albers et al. ..... 62/271
2005/0236145 A1 10/2005 Arai et al.
2006/0130654 A1 6/2006 King et al.
2007/0101862 A1 5/2007 Tongue
2008/0307802 A1 12/2008 Forkosh
2009/0211276 A1 * 8/2009 Forkosh ..... 62/94

FOREIGN PATENT DOCUMENTS

FR 2574908 A1 * 6/1986 ..... 62/271
WO 96/33378 A1 10/1996
WO 0055546 9/2000
WO 02066901 A1 8/2002
WO 02086391 A1 10/2002
WO 03056249 A1 7/2003
WO 2004046618 A1 6/2004
WO 2005057114 A1 6/2005
WO 2006026494 A1 3/2006
WO 2006129200 A2 12/2006
WO 2007066212 A2 6/2007
WO 2007066212 A3 6/2007

* cited by examiner

SYSTEM AND METHOD FOR MANAGING WATER CONTENT IN A FLUID

CROSS-REFERENCE TO RELATED APPLICATIONS

This application is the national stage of International Application No. PCT/IB07/04333 filed on Aug. 27, 2007.

This application claims the benefit of U.S. provisional application Ser. No. 60/840,312 filed 25 Aug. 2006, which is hereby incorporated herein by reference.

BACKGROUND OF THE INVENTION

1. Field of the Invention

The present invention relates to a system and method for managing water content in a fluid.

2. Background Art

Conventionally, water is collected from air, or other gaseous fluids, using condensation systems. An exemplary condensation system provides a surface cooled to a temperature that is at or below the dew point of incoming air. As is well known in the art, the cooling of air at or below its dew point causes the condensation of water vapor from the air and a decrease in the absolute humidity of the air. The humidity of a volume of air is substantially determinative of the amount of water that can be introduced into, or removed from, the volume of air.

The humidity and temperature of air varies, however, from region to region, with hot and humid air in tropical and semi-tropical regions, and cooler, less humid air in other parts of the world. The temperature and water vapor content of air also varies widely with seasonal weather changes in regions throughout the year. Therefore, depending on the region of the world, and depending on the time of year, humidification or dehumidification may be desirable, for example, to make an environment more comfortable.

In addition to increasing comfort, management of the amount of water in air may be important to industrial applications. Moreover, it may be desirable to remove water from air so that the water can be utilized, for example, for drinking, or in other applications where fresh water is desired. Regardless of the reason for managing the amount of water in the air, there are times when conventional water management systems have undesirable limitations. For example, when the dew point of the air is low, particularly when it is below the freezing point of water, it may be difficult or impossible to remove the water using a condensation system. One way to remove water from air even when the dew point is low is to use a system utilizing a desiccant to extract water from the air.

In a desiccant system, both heat and mass are transferred to and from the air. Conventional systems of this type are generally inefficient in at least one of the two types of transfer—i.e., heat or mass transfer—because the transfer of one inherently transfers the other, which may be undesirable. For example, a desiccant wheel can be used to remove water vapor from an airflow, thereby transferring mass out of the air and reducing the enthalpy of the air. At the same time, however, a large amount of heat may be added by the phase change occurring as the water condenses out of the air; this causes an increase in the enthalpy of the air.

Conventional desiccant based dehumidifiers generally require the movement of the desiccant from a first region where it absorbs moisture—i.e., a "collection" or "dehumidfying" station—to a second region where it expels the moisture—i.e., a regeneration station. In the case of solid desiccants, this transfer is achieved by physically moving the desiccant from a dehumidifying station to a regeneration station, for example, by mounting the desiccant on a rotating wheel, a belt or the like. In liquid desiccant systems, two pumps are generally provided: one for pumping the liquid to the regeneration station, and the other for pumping the liquid from the regeneration station to the dehumidifying station. In some embodiments, a single pump is used to pump from one station to the other, with the return flow being gravity fed.

One such system removes air from a first airflow by spraying the first airflow with a liquid desiccant. The desiccant may be cooled prior to being sprayed. Water removed from the air is collected by the desiccant, which becomes increasingly diluted. The cool, diluted desiccant is collected in the bottom of a collection chamber. On the other side of the system, the diluted desiccant is heated and brought into contact with a second airflow, which removes the water from the desiccant, thereby leaving it more concentrated. The warm, concentrated desiccant is collected in the bottom of a regeneration chamber.

The two chambers may be connected, for example by an orifice, to allow mixing of the diluted and concentrated desiccant pools. Because a concentration gradient will exist between the diluted and concentrated desiccants, diffusion between the two chambers will naturally occur. Although the orifice may be an efficient mechanism to transfer mass—i.e., the water ions—it also facilitates heat transfer as the warm, concentrated desiccant mixes with the cool, diluted desiccant. This may be acceptable in some applications, but in others, it may be desirable to have a system that controls both heat and mass transfer.

Another type of air conditioning desiccant system is described in U.S. Pat. No. 4,941,324 issued to Peterson et al. on 17 Jul. 1990. Peterson et al. describes a mechanism to transfer liquid desiccant between a condenser sump and an evaporator sump. Dilute desiccant from the evaporator sump is transferred into the condenser sump, and concentrated desiccant from the condenser sump is transferred back to the evaporator sump. The transfer mechanism includes a pair of pumps and a series of globe valves that control the amount of desiccant transferred between the sumps and the amount of desiccant delivered to desiccant distributors.

One limitation of the Peterson et al. system is limited control over the amount of desiccant transferred between the sumps. Specifically, such a system may result in undesirably large quantities of desiccant being pumped between the two sumps in order to continuously regenerate the desiccant. Because the temperature of the desiccant in the condenser sump may be significantly higher than the temperature of the desiccant in the evaporator sump, an undesirable amount of heat transfer can occur as the large mass of liquid is transferred between the sumps. This can be very inefficient. To help reduce this inefficiency, the Peterson et al. system utilizes a heat exchanger to transfer heat between the two desiccant streams as they are pumped between the two sumps. Although this may reduce some of the inefficiency, the process may yet be undesirably inefficient because of the large quantity of liquid being transferred.

In many different fields—e.g., air conditioning, collecting water from air, and generating power using a combustion engine or gas turbine—controlling the transfer of both heat and mass of one or more materials is important to the overall efficiency of the process. Therefore, there is a need for a system and method for managing the water content in a fluid that can extract water from the fluid under a variety of ambient conditions utilizing a desiccant that is at least partly liquid, and that can efficiently control the transfer of both mass and heat of the water to and from the desiccant.

SUMMARY OF THE INVENTION

Embodiments of the present invention provide a system and method for managing water content in a fluid using a desiccant that is at least partly liquid, and in which the mass transfer and the heat transfer of the water to and from the desiccant are controlled. Such a system and method can be used in the areas of air conditioning, water production, environmental control, and energy production.

Embodiments of the invention also provide a system and method for managing water content in a fluid in which cooled desiccant is diluted as it removes water from an airflow, and is collected in a sump of a collection chamber. Diluted desiccant is transferred to a regeneration chamber, where it is heated and brought into contact with another airflow. This effects removal of the water from the desiccant, and the now concentrated desiccant is collected in a sump of the regeneration chamber. The desiccant in the sumps is mixed in such a way as to efficiently control the transfer of heat and mass of the water in the desiccant pools.

In one embodiment, the two sumps are connected by an aperture, such as an orifice. When the liquid desiccant is sprayed in the collection chamber, its mass and volume increase as it removes water from the air. As the desiccant continues to pickup more water from the airflow, its level in the collection sump rises. When it exceeds the level of the orifice, some of the diluted desiccant enters the regeneration chamber and mixes with the more concentrated desiccant in the regeneration sump; this causes the level of the desiccant in the regeneration sump to rise. When the desiccant in the regeneration chamber reaches a predetermined level, a float-actuated valve opens to allow some of the desiccant to be pumped back into the collection chamber. In this way, mass is not transferred from the collection chamber to the regeneration chamber until the desiccant level in the collection chamber reaches the orifice. Similarly, mass is not transferred from the regeneration chamber to the collection chamber until the desiccant level in the collection chamber moves the float to actuate the valve. The orifice and the float switch can be positioned as desired, such that the mass flow is efficiently controlled.

Because the temperatures of the desiccant in the two sumps is likely to be different—the desiccant in the collection sump being cooler than the desiccant in the regeneration sump—the invention also controls the heat transfer between the two desiccant chambers. In one embodiment, the warmer, concentrated desiccant from the regeneration sump is passed through a heat exchanger—e.g., an evaporator of a refrigeration system—before it enters the collection chamber. This cools the concentrated desiccant, and may reduce the required energy input into the system, since the desiccant in the collection chamber will not require as much cooling prior to its being sprayed on the airflow in the collection chamber.

In another embodiment of the invention, the desiccant in the collection sump is cooled using an evaporative heat exchanger, which is part of a refrigeration vapor compression cycle, prior to being brought into contact with the airflow. Similarly, the concentrated desiccant from the regeneration sump is passed through a heat exchanger to pickup heat prior to being sprayed on the airflow in the regeneration chamber. In some embodiments, the heat exchanger may be part of a separate refrigeration cycle, or alternatively, may be connected to another heat-producing device, such as an engine or generator. In other embodiments, the heat exchanger may be a condenser that is part of the same refrigeration cycle as the evaporator.

To effect efficient transfer of heat between the two chambers, a system heat exchanger may be used. The system heat exchanger can be configured to receive both streams of desiccant as they are transferred from one chamber to another. Specifically, the cooler, diluted desiccant leaves the collection sump when it reaches the level of the orifice. It then flows through the system heat exchanger and into the regeneration chamber. On the other side, warmer, concentrated desiccant is pumped through the system heat exchanger when the level in the regeneration sump is high enough to actuate the float valve. In the system heat exchanger, the desiccant being pumped to the collection chamber gives up heat, while the desiccant flowing into the regeneration chamber picks up heat. In this way, less cooling is required of the collection chamber desiccant, and less heating is required of the regeneration chamber desiccant. Thus, the heat transfer and the mass transfer are both controlled to provide an efficient system.

The systems described above can be adapted for use in a number of different fields. For example, such a system can be used in environmental control to dehumidify and cool the air in an interior space. Alternatively, or in concert with the environmental control system, the water retained by the airflow in the regeneration chamber can be collected for use as potable or non-potable water. Such water collection can be effected by passing the moist airflow leaving the regeneration chamber through an evaporator of a refrigeration system. In some embodiments, the airflows leaving the collection and regeneration chambers may be passed through a heat exchanger to transfer heat between the two airflows, thereby resulting in condensation and water collection from the moist airflow.

At least one embodiment of the present invention can sterilize and filter the condensed water to generate pure drinking water. Accordingly, in one embodiment, condensed water from the condensate collector is exposed to suitable ultraviolet (UV) radiation in a UV unit to free the water from harmful microscopic organisms. Additionally, the radiated water is serially passed through a charcoal filter to remove contaminants and Volatile Organic Compounds (VOC's) and a plurality of mineral cartridges to mineralize and/or vitaminize the water. The purified and mineralized water is collected in a first storage tank. Additionally, the water is passed through an oxygenator before being stored in the first storage tank. Water from the first storage tank is recirculated through the UV unit at predetermined intervals of time to maintain quality of water. Embodiments of the present invention may also be configured to provide for the introduction of water from external sources in the event of low condensate formation. Accordingly, an external source such as a municipal supply faucet is attached through quick-disconnect fittings to supply supplemental water to the first storage tank.

DETAILED DESCRIPTION OF EMBODIMENTS OF THE INVENTION

Figure 1:
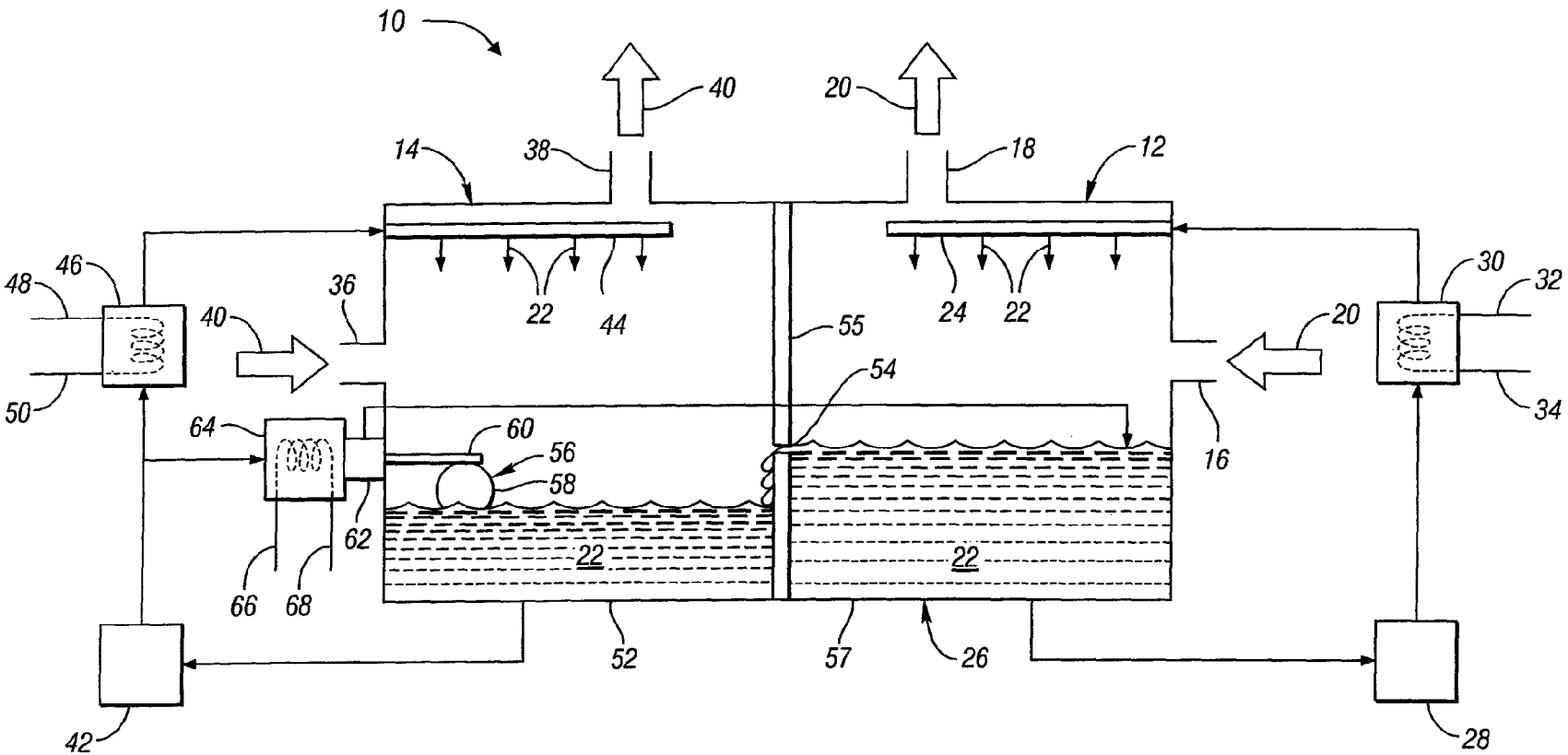
FIG. 1 shows a schematic diagram of a system for managing water content in a fluid in accordance with one embodiment of the present invention.

FIG. 1 shows a system 10 for managing water content in a fluid in accordance with one embodiment of the present invention. In particular, the system 10 is configured to manage the water content in air—either to collect water from the air for storage and subsequent use, or to control the humidity of the air. It is worth noting that although the examples presented herein utilize ambient air as the fluid whose water content is being managed, the present invention is capable of managing the water content of other fluids as well. The system 10 includes a first chamber, or collection chamber 12, and a second chamber, or regeneration chamber 14. The collection chamber 12 includes an inlet 16 and an outlet 18 which allow a first airflow 20 to flow through the collection chamber 12. As the air flows through the collection chamber 12, it contacts a desiccant 22, which, in the embodiment shown in FIG. 1, is sprayed into the chamber 12 via a conduit 24.

As the air moves through the collection chamber 12, vaporized water is condensed out, and collects with the desiccant 22 in a collection sump 26 in the bottom portion of the chamber 12. The desiccant 22 is diluted as it adsorbs or absorbs the water from the air. Although the desiccant 22 shown in FIG. 1 is all liquid, the present invention contemplates the use of dual phase desiccants—e.g., solid and liquid. Any desiccant material effective to produce the desired result may be used, including lithium chloride (LiCl) and calcium chloride ($CaCl_2$), which are typical of liquid desiccant solutions; however, other liquid desiccants may be employed.

Liquid desiccants such as polycols, alone or in mixture, may be used. Typical polycols include liquid compounds such as ethylene glycol, propylene glycol, butylene glycol, pentylene glycol, glycerol, trimethyol propane, diethytlene glycol, triethylene glycol, tetraethylene glycol, dipropylene glycol, tripropylene glycol, tetrapropylene glycol, and mixtures thereof. Polyol compounds which are normally solid, but which are substantially soluble in anhydrous liquid polyols or liquid hydroxyl amines, may also be used. Typical of these solid polyol compounds are erythritol, sorbitol, pentaerythritol and low molecular weight sugars. Typical hydroxyl amines include alkanolamines, such as monoethanol amine, diethanol amine, triethanol amine, isopropanol amine, including mono, di, and tri, isopropanol amine or digylcolamine.

As noted above, the desiccant 22 is a liquid desiccant, which may be a pure substance, or may comprise an aqueous solution of 40% lithium chloride. The desiccant 22 is pumped into the conduit 24 by a pump 28. The pump 28 pumps the desiccant 22 through a first heat exchanger 30 prior to its introduction into the collection chamber 12. By cooling the desiccant 22, its ability to remove water from the first airflow 20 is increased. A fluid, such as a refrigerant, is passed through the heat exchanger 30 via conduits 32, 34. For example, the heat exchanger 30 may be an evaporator that is part of a refrigeration system. Such a refrigeration system can be used to control ambient environmental conditions, or for some other purpose or purposes. The desiccant 22 is cooled in the heat exchanger 30 to a temperature below that of the first airflow 20. In this way, the airflow 20 is cooled as it passes through the collection chamber 12. As an alternative to the heat exchanger 30, a heat exchanger may be placed inside the collection chamber 12 to cool the first airflow 20 directly, or to cool the desiccant 22 after it is sprayed into the collection chamber 12.

The regeneration chamber 14 also includes an inlet 36 and an outlet 38, which facilitate movement of a second airflow 40 into and out of the regeneration chamber 14. As with the collection chamber 12, the regeneration chamber 14 also includes a pump 42 which is used to pump the desiccant 22 into the regeneration chamber 14 through a conduit 44. The desiccant 22 is pumped by the pump 42 through a second heat exchanger 46. Heat can be added to the heat exchanger 46 from any convenient source, via conduits 48, 50. For example, the heat exchanger 46 can be a condenser that forms part of a refrigeration system. Such a refrigeration system can be the same refrigeration system using the heat exchanger 30. In such a case, the heat exchangers would each be connected to a compressor, or refrigerant pump, thereby allowing the system 10 to generate its own heating and cooling without relying on any external sources. Alternatively, the heat exchanger 46 could receive heat from other sources, such as combustion engines or generators.

By passing through the heat exchanger 48, the desiccant 22 is heated to a temperature above the temperature of the second airflow 40, so that the second airflow 40 is heated as it passes through the regeneration chamber 14. By heating the second airflow 40, more water is evaporated from the desiccant 22 into the second airflow 40. As an alternative to the heat exchanger 46, which is located outside the regeneration chamber 14, a heat exchanger (not shown) may be located inside the regeneration chamber 14. After the desiccant 22 is sprayed over the airflow 40 in the regeneration chamber 14, it collects in a regeneration sump 52 at the bottom of the regeneration chamber 14. The warm, humid airflow 40 leaving the regeneration chamber 14 can be introduced into another heat exchanger (not shown) to remove water from the airflow 40.

As described above, the present invention provides an efficient mechanism for transferring heat and mass in a system, such as the system 10. An aperture, which in the embodiment shown in FIG. 1 is an orifice 54, is provided in a wall 55 of the collection chamber 12 at some predetermined height from a bottom 57 of the chamber 12. In some embodiments, the orifice 54 may be generally rectangular with rounded corners, having a width of approximately 1-3 centimeters (cm), and a height of approximately 1-10 cm, depending on the capacity of the system 10. As the amount (mass) of water collected by the desiccant 22 in the collection chamber 12 increases, the level of the desiccant 22 in the sump 26 also increases. When the level exceeds that of the orifice 54, some of the dilute desiccant 22 in the collection chamber enters the regeneration chamber 14 and mixes with the more concentrated desiccant 22 in the sump 52. In this way, no mass transfer from the collection chamber 12 to the regeneration chamber 14 occurs until it is efficient—i.e., until the desiccant in the sump 26 reaches the predetermined level.

In the regeneration chamber 14, the warm desiccant 22 loses water as it is sprayed into the airflow 40; therefore, the level of the desiccant in the sump 52 tends to decrease. An increase in the desiccant level in the sump 52 will occur, however, when the dilute desiccant 22 enters the regeneration chamber 14 through the orifice 54. Eventually, the level of the desiccant in the regeneration chamber 14 will reach a maximum desired level. In order to control the mass transfer from the regeneration chamber 14 to the collection chamber 12, a level sensor is provided. In the embodiment shown in FIG. 1, the level sensor is a float system 56. The float system 56 includes a float 58, attached to an actuator 60, which operates a valve 62 between open and closed positions. In the embodiment shown in FIG. 1, the valve 62 is located downstream from a heat exchanger 64, the operation of which is explained more fully below. In other embodiments, a heat exchanger, such as the heat exchanger 64, may be downstream from the valve 62.

When the level of the desiccant 22 in the regeneration chamber 14 reaches a first predetermined level, the float 58 causes the actuator 60 to facilitate opening of the valve 62. In the open position, the valve 62 allows some of the desiccant 22 pumped by the pump 42 to be transferred back into the collection chamber 12. In this way, the float system 56 controls the transfer of mass from the regeneration chamber 14 to the collection chamber 12. In the embodiment shown in FIG. 1, the valve is an electromechanical device, such as a solenoid valve, and movement of the actuator 60 actuates a switch that allows current to energize a coil to open the solenoid. In other embodiments, the valve 62 may be mechanically connected to the actuator 60, such that movement of the actuator 60 mechanically opens and closes the valve 62. Other embodiments may use a non-contact level sensor, such as a capacitive sensor, which are known in the art. When the level of the desiccant 22 in the regeneration chamber falls below a second predetermined level, the actuator 60 causes the valve 62 to close. The first and second predetermined levels may be substantially the same, or they may be offset to provide a hysteresis such that the valve does not open and close repeatedly for slight fluctuations in the desiccant level.

In addition to controlling the mass transfer, the system 10 also controls the heat transfer between the two chambers 12, 14. In the embodiment shown in FIG. 1, this is accomplished with the float system 56 in conjunction with the heat exchanger 64. Although not shown in FIG. 1, it is understood that the heat exchanger 64 can be connected, for example, by conduits 66, 68 to a refrigeration system, or other system that provides a flow therethrough to cool the desiccant 22 as it is pumped through the heat exchanger 64. Cooling the desiccant 22 before it is pumped back into the collection chamber 12 reduces the energy input required into the heat exchanger 30. This provides an efficient control mechanism for the transfer of heat between the chambers 12, 14.

Figure 2:
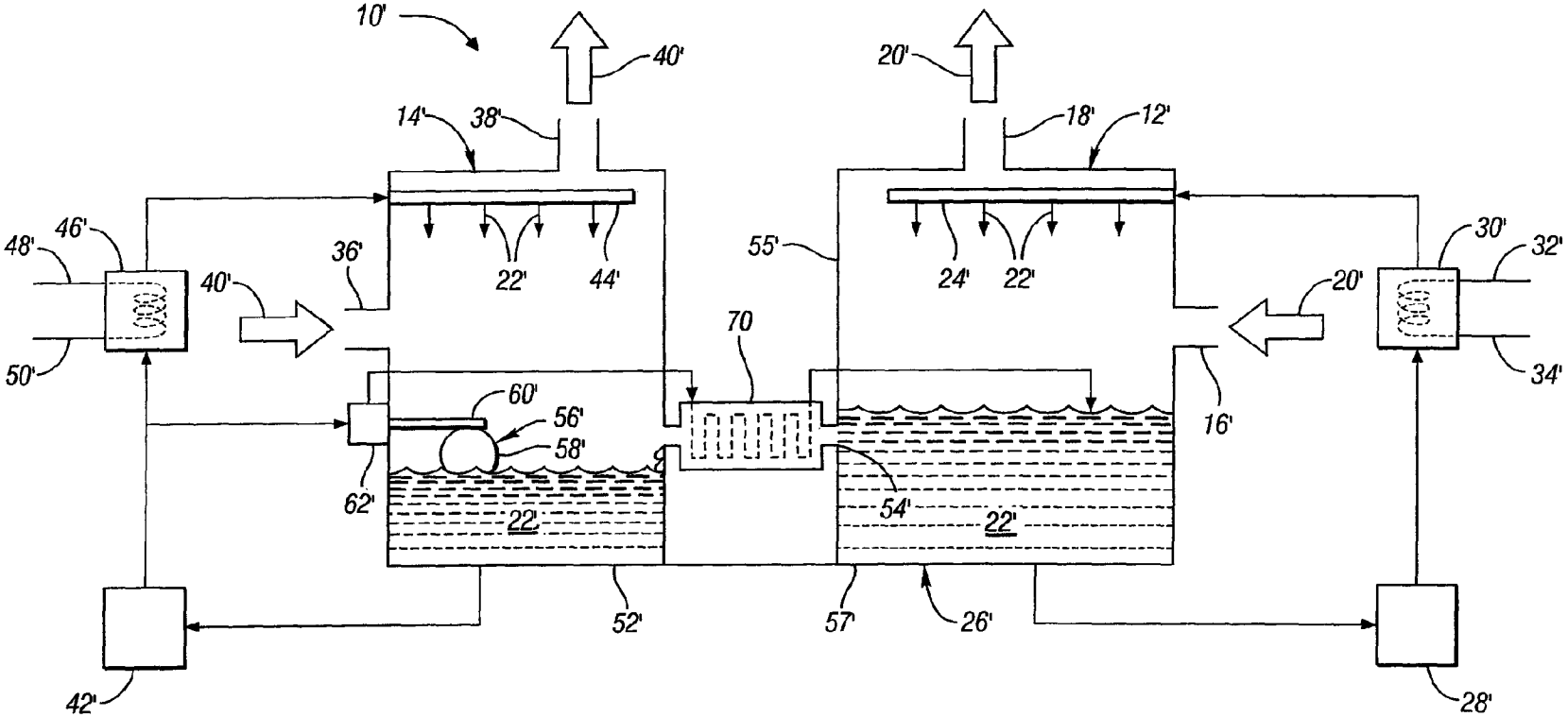
FIG. 2 shows a schematic diagram of a system for managing water content in a fluid in accordance with another embodiment of the present invention.

FIG. 2 illustrates a system 10' for managing the water content in air in accordance with another embodiment of the present invention. Elements of the system 10' are labeled with the same number as their respective counterparts in the system 10, shown in FIG. 1, and are further designated with the prime (') symbol. As with the system 10, the system 10' includes collection and regeneration chambers 12', 14', each of which has its own heat exchanger 30', 46' for controlling the temperature of the desiccant 22'. Unlike the system 10, where the collection and regeneration chambers 12, 14 were effectively abutted against each other, the chambers 12', 14' in the system 10' are separated by a heat exchanger 70, the function of which is explained in more detail below.

To effect control of the mass and heat transfer between the two chambers 12', 14', the system 10' includes an orifice 54' in the collection chamber 12'. When the level of the desiccant 22' in the sump 26' exceeds the level of the orifice 54', desiccant will flow from the collection chamber 12' to the regeneration chamber 14'. This controls mass transfer from the collection chamber 12' to the regeneration chamber 14'. Unlike the system 10, however, the desiccant 22' does not flow directly into the regeneration chamber 14', rather, it flows through the heat exchanger 70.

Like the system 10, the system 10' also includes a float system 56', having a float 58' and an actuator 60', which actuates a valve 62'. When the level of the desiccant 22' in the sump 52' reaches a predetermined level, the float 58' moves the actuator 60', which opens the valve 62'. This allows desiccant 22' to be pumped from the regeneration chamber 14' to the collection chamber 12', and effectively controls the mass flow.

To effect control of the heat transfer between the two chambers 12', 14', the heat exchanger 70 is also used. As shown in FIG. 2, the heat exchanger 70 is connected to the valve 62', so that when the actuator 60' opens the valve 62', the warm desiccant from the sump 52' is pumped through the heat exchanger 70. As the cooler desiccant 22' passes through the heat exchanger 70 from the collection chamber 12' on its way to the regeneration chamber 14', it picks up heat from the desiccant 22' leaving the regeneration chamber 14'. In this way, the desiccant 22' entering the regeneration chamber 14' is warmer than when it left the collection chamber 12', and the desiccant 22' entering the collection chamber 12' is cooler than when it left the regeneration chamber 14'. This means that less energy is required to respectively heat and cool the heat exchangers 46' 30', thereby resulting in an increase in efficiency, and overall energy savings. In other embodiments, multiple heat exchangers may be used, such as a combination of the heat exchanger 64 shown in FIG. 1 and the heat exchanger 70 shown in FIG. 2.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for managing water content in a fluid, comprising:

a first chamber including an inlet and an outlet for facilitating movement of a first fluid into and out of the first chamber;

a desiccant capable of being introduced into the first chamber for removing water from the first fluid moving through the first chamber;

a second chamber including an inlet and an outlet for facilitating movement of a second fluid into and out of the second chamber, thereby facilitating evaporation of water from the desiccant in the second chamber into the second fluid, one chamber of the first and second chambers including a bottom and a wall having an aperture therein disposed at a predetermined height from the bottom such that desiccant overflows from the one chamber and automatically enters the other chamber of the first and second chambers through the aperture when the desiccant in the one chamber reaches a level at least as high as the aperture;

a valve configured to receive desiccant from the other chamber and having an open position for facilitating a flow of desiccant from the other chamber to the one chamber, and a closed position for inhibiting the flow of desiccant from the other chamber to the one chamber;

a level sensor at least partially disposed within the other chamber and configured to open the valve when the level of the desiccant in the other chamber reaches at least a first predetermined level, and to close the valve when the level of the desiccant in the other chamber drops below a second predetermined level; and a pump configured to pump the desiccant from the other chamber to the one chamber when the valve is open.

2. The system for managing water of claim 1, wherein the desiccant includes a liquid desiccant.

3. The system for managing water of claim 1, wherein the one chamber is the first chamber, and the other chamber is the second chamber.

4. The system for managing water of claim 3, further comprising a heat exchanger configured to receive desiccant pumped from the second chamber to the first chamber and to remove heat from the desiccant before it enters the first chamber.

5. The system for managing water of claim 4, wherein the heat exchanger is positioned to create a fluid path between the first and second chambers, and is further configured to:

receive desiccant from the first chamber as it exits the first chamber through the aperture, and facilitate flow of the exiting desiccant from the first chamber to the second chamber, and facilitate the transfer of heat from the desiccant being pumped from the second chamber to the desiccant exiting the first chamber through the aperture.

6. The system for managing water of claim 4, wherein the heat exchanger is connected to an external cooling source for removing the heat from the desiccant before it enters the first chamber.

7. The system for managing water of claim 4, wherein the heat exchanger is disposed upstream of the valve such that it receives desiccant pumped from the second chamber prior to the desiccant flowing through the valve.

8. The system for managing water of claim 7, wherein the heat exchanger is connected to an external cooling source for removing the heat from the desiccant before it enters the first chamber.

9. The system for managing water of claim 1, wherein the level sensor includes a float system having a float and an actuator configured to cooperate with the float and to actuation of the valve between the open and closed positions.

10. The system for managing water of claim 1, wherein the valve includes an electro-mechanical apparatus for opening and closing the valve.

11. The system for managing water of claim 1, wherein the aperture has a width of approximately 1-3 centimeters (cm), and a height of approximately 1-10 cm.

12. A method for managing water content in a fluid using a system including a first chamber including an inlet and an outlet to facilitate movement of a first fluid into and out of the first chamber, a liquid desiccant capable of being introduced into the first chamber for removing water from the first fluid moving through the first chamber, and a second chamber including an inlet and an outlet for facilitating movement of a second fluid into and out of the second chamber to facilitate evaporation of water from the desiccant in the second chamber into the second fluid, one chamber of the first and second chambers including a wall and a bottom, the method comprising:

removing water from the first fluid using a process that includes exposing at least some of the first fluid to the desiccant, thereby increasing the water content of at least some of the desiccant;

introducing at least some of the desiccant having increased water content into a second fluid, thereby facilitating evaporation of water from the desiccant into the second fluid and increasing water content of the second fluid;

providing an aperture in the wall of the one chamber at a predetermined height from the bottom such that desiccant overflows from the one chamber and automatically enters the other chamber of the first and second chambers through the aperture when the desiccant in the one chamber reaches a level at least as high as the aperture;

automatically transferring desiccant from the other chamber of the first and second chambers to the one chamber when the when the level of the desiccant in the other chamber reaches at least a first predetermined level; and automatically stopping the transfer of the desiccant from the other chamber to the one chamber when the level of the desiccant in the other chamber drops below a second predetermined level.

13. The method of claim 12, wherein the first predetermined level is greater than the second predetermined level.

14. The method of claim 13, wherein the step of automatically transferring desiccant from the other chamber to the one chamber includes automatically opening a valve when the level of the desiccant in the other chamber reaches at least the first predetermined level, and wherein the step of automatically stopping the transfer of the desiccant from the other chamber to the one chamber includes automatically closing the valve when the level of the desiccant in the other chamber drops below the second predetermined level.

15. The method of claim 12, further comprising cooling the desiccant being transferred from the other chamber to the one chamber before it reaches the one chamber.

16. The method of claim 15, wherein the step of cooling the desiccant being transferred from the other chamber to the one chamber includes transferring heat from the desiccant to a cooling source external to the system.

17. The method of claim 12, the other chamber being configured to receive the desiccant exiting the one chamber through the aperture, the method further comprising heating the desiccant after it exits the one chamber before it enters the other chamber.

18. The method of claim 17, wherein the step of heating the desiccant after it exits the one chamber includes transferring heat to the exiting desiccant from the desiccant being automatically transferred from the other chamber to the one chamber.

* * * * *